US007675398B2

(12) United States Patent
Endou et al.

(10) Patent No.: US 7,675,398 B2
(45) Date of Patent: Mar. 9, 2010

(54) IRON CORE FOR STATIONARY APPARATUS AND STATIONARY APPARATUS

(75) Inventors: Hiroyuki Endou, Agano (JP); Makoto Shinohara, Tainai (JP); Masanao Kuwabara, Tainai (JP); Yoichi Amako, Niigata (JP); Toshiki Shirahata, Shibata (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 816 days.

(21) Appl. No.: 11/481,865

(22) Filed: Jul. 7, 2006

(65) Prior Publication Data

US 2008/0272876 A1 Nov. 6, 2008

(30) Foreign Application Priority Data

Jul. 8, 2005 (JP) ..... 2005-199545
Oct. 3, 2005 (JP) ..... 2005-289510

(51) Int. Cl.
*H01F 27/24* (2006.01)

(52) U.S. Cl. ..... 336/234

(58) Field of Classification Search ..... 336/65, 336/83, 212–215, 233–234
See application file for complete search history.

(56) References Cited

U.S. PATENT DOCUMENTS 2,982,948 A * 5/1961 Brownlow et al. ..... 365/133
3,454,916 A * 7/1969 Hoover ..... 336/60
4,205,288 A * 5/1980 Lin et al. ..... 336/5
4,520,335 A * 5/1985 Rauch et al. ..... 336/212
4,565,746 A * 1/1986 Hayase ..... 428/638
5,371,486 A * 12/1994 Yamada et al. ..... 336/212

FOREIGN PATENT DOCUMENTS

| | | |
|---|---|---|
| JP | 61-15309 | 1/1986 |
| JP | 05-101943 | 4/1993 |
| JP | 06-120044 | 4/1994 |
| JP | 10-270263 | 10/1998 |
| JP | 2003-142318 | 5/2003 |

* cited by examiner

*Primary Examiner*—Tuyen Nguyen
(74) *Attorney, Agent, or Firm*—Antonelli, Terry, Stout & Kraus, LLP.

(57) ABSTRACT

Magnetic flux in a magnetic flux distribution inside a wound iron core for a stationary apparatus is mal-distributed toward the inner periphery side where the magnetic path of a laminated magnetic steel sheet is short with respect to the total lamination thickness and magnetic resistance is small and the inner periphery side on which magnetic flux is concentrated has a high magnetic flux density and increased iron loss, and therefore magnetic steel sheets of different magnetic characteristics are disposed at an arbitrary lamination ratio to make uniform the magnetic flux distribution inside the same wound iron core. In order to make uniform the magnetic flux distribution inside the wound iron core for a stationary apparatus, such a structure is adopted that a magnetic steel sheet having a magnetic characteristic inferior to that on the outer periphery side is disposed on the inner periphery side having a shorter magnetic path and smaller magnetic resistance and a magnetic steel sheet having a magnetic characteristic superior to that on the inner periphery side is disposed on the outer periphery side having a longer magnetic path and greater magnetic resistance to thereby make uniform the magnetic flux distribution in a sectional area of the iron core.

8 Claims, 7 Drawing Sheets

(a)

(b)

DETAILED DRAWING OF PART A
(DRAWING OF WOUND IRON CORE MAGNETIC FLUX DISTRIBUTION)

* SUPPOSE IRON LOSS OF MAGNETIC FLUX DENSITY 1.70T OF WOUND IRON CORE No.1 IS 100%

* SUPPOSE IRON LOSS OF WOUND IRON CORE No.1 IS 100%

IRON CORE FOR STATIONARY APPARATUS AND STATIONARY APPARATUS

INCORPORATION BY REFERENCE

The present application claims priority from Japanese applications JP2005-199545 filed on Jul. 8, 2005, JP2005-289510 filed on Oct. 3, 2005, the contents of which are hereby incorporated by reference into this application.

BACKGROUND OF THE INVENTION

The present invention relates to a wound iron core for a stationary apparatus such as a transformer or reactor, or more particularly, to a wound iron core made up of magnetic steel sheets having a magnetic characteristic (hereinafter refers to iron loss, magnetic permeability) laminated inside the same iron core at an arbitrary distribution ratio of lamination thickness and a stationary apparatus including such a wound iron core.

Magnetic steel sheets of an identical type having an identical magnetic characteristic are laminated inside the same iron core of a wound iron core for a transformer. As part of measures against global warming, there is a tendency toward low loss transformers in recent years, and in order to reduce iron loss (non-load loss) generated in an iron core or copper loss (load loss) generated in a coil, the former is designed to increase the amount of magnetic steel sheet used and secure a greater sectional area of the iron core to thereby reduce a magnetic flux density or use an expensive low loss magnetic steel sheet, which leads to upsizing of iron cores and increases in cost.

Furthermore, Patent Document 1 (JP-A-10-270263) describes an amorphous iron core composed of amorphous sheet block members of relatively low quality material in magnetic characteristic inside and those of relatively high quality material outside in forming amorphous sheet block members.

SUMMARY OF THE INVENTION

It is generally known that magnetic flux in a magnetic flux distribution inside a wound iron core for a stationary apparatus is mal-distributed toward the inner periphery side where the magnetic path of laminated magnetic steel sheets is short and magnetic resistance is small. Thus, the magnetic flux density becomes higher and iron loss deteriorates on the inner periphery side of the wound iron core where magnetic flux is concentrated, and therefore it is important to make uniform the magnetic flux distribution inside the wound iron core in realizing low loss.

It is an object of the present invention to provide an iron core for a stationary apparatus with magnetic steel sheets of different magnetic characteristics arranged at an arbitrary ratio of lamination thickness to make uniform a magnetic flux distribution inside the same wound iron core.

In order to solve the above described problems, the present invention disposes a magnetic steel sheet having a magnetic characteristic inferior to that on an outer periphery side on an inner periphery side having a shorter magnetic path and smaller magnetic resistance and disposes a magnetic steel sheet having a magnetic characteristic superior to that on the inner periphery side on the outer periphery side having a longer magnetic path and greater magnetic resistance to thereby make uniform the magnetic flux distribution in a sectional area of the iron core, prevent the magnetic flux density on the inner periphery side of the wound iron core from increasing and improve iron loss.

Furthermore, the wound iron core for a stationary apparatus according to the present invention is characterized in that the magnetic steel sheet having a magnetic characteristic inferior to that on the outer periphery side is disposed on the inner periphery side having a shorter magnetic path and smaller magnetic resistance such that the thickness thereof accounts for 40% or less of the total lamination thickness of the wound iron core and the magnetic steel sheet having a magnetic characteristic superior to that on the inner periphery side is disposed on the outer periphery side.

Furthermore, the wound iron core for a stationary apparatus according to the present invention is characterized in that a highly oriented silicon steel sheet is used for the magnetic steel sheet on the inner periphery side of the wound iron core and a magnetic domain controlled silicon steel sheet is used for the magnetic steel sheets on the outer periphery side thereof.

Furthermore, the three-phase three-leg wound iron core made up of 2 inner iron cores and 1 outer iron core is characterized in that each iron core is formed so that at least one leg of U-leg, V-leg and W-leg is made of a combination of magnetic steel sheets of different magnetic characteristics and each iron core is formed so that a magnetic material having an inferior magnetic characteristic accounts for 50% or less of the total lamination thickness of one leg.

Furthermore, the stationary apparatus provided with a wound iron core made up of laminated magnetic steel sheets is characterized in that a magnetic steel sheet having a magnetic characteristic inferior to that on the outer periphery side is disposed on the inner periphery side having a shorter magnetic path and smaller magnetic resistance and a magnetic steel sheet having a magnetic characteristic superior to that on the inner periphery side is disposed on the outer periphery side having a longer magnetic path and greater magnetic resistance.

Furthermore, the above described stationary apparatus is characterized in that the magnetic steel sheet having a magnetic characteristic inferior to that on the outer periphery side is disposed on the inner periphery side having a shorter magnetic path and smaller magnetic resistance such that the thickness thereof accounts for 40% or less of the total lamination thickness of the wound iron core and the magnetic steel sheet having a magnetic characteristic superior to that on the inner periphery side is disposed on the outer periphery side.

Furthermore, the above described stationary apparatus is characterized in that a highly oriented silicon steel sheet is used for the magnetic steel sheet on the inner periphery side of the wound iron core and a magnetic domain controlled silicon steel sheet is used for the magnetic steel sheet on the outer periphery side thereof.

Furthermore, the above described stationary apparatus is characterized in that the three-phase three-leg wound iron core made up of 2 inner iron cores and 1 outer iron core is characterized in that each iron core is formed so that at least one leg of U-leg, V-leg and W-leg is made of a combination of magnetic steel sheets of different magnetic characteristics and each iron core is formed so that a magnetic material having an inferior magnetic characteristic accounts for 50% or less of the total lamination thickness of one leg.

Other objects, features and advantages of the invention will become apparent from the following description of the embodiments of the invention taken in conjunction with the accompanying drawings.

DETAILED DESCRIPTION OF THE INVENTION

With reference now to the attached drawings, embodiments of a wound iron core structure according to the present invention will be explained below.

Figure 2:
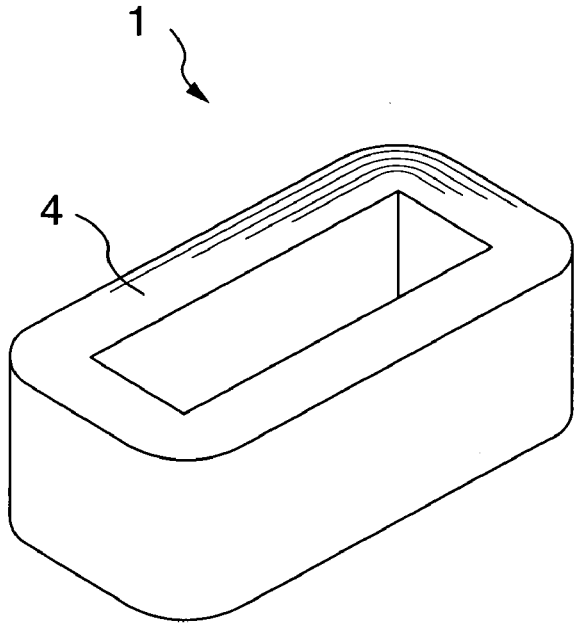
FIG. 2 is a perspective view showing the structure of a conventional wound iron core.
Figure 3:
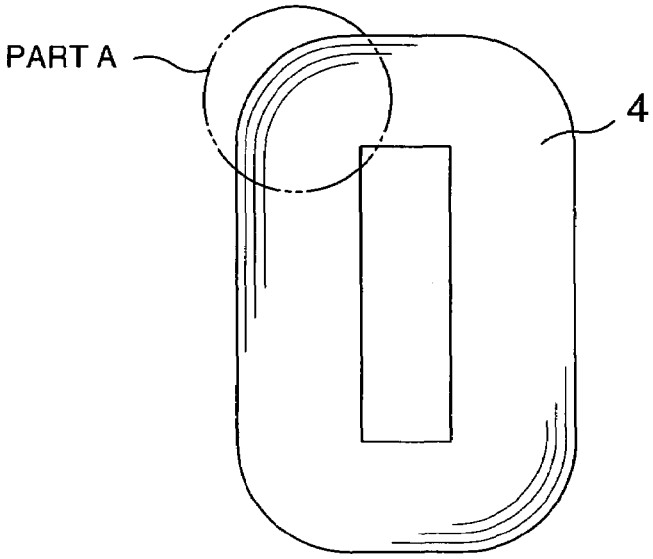
FIG. 3 is a diagram showing a magnetic flux distribution of the conventional wound iron core.
Figure 3:
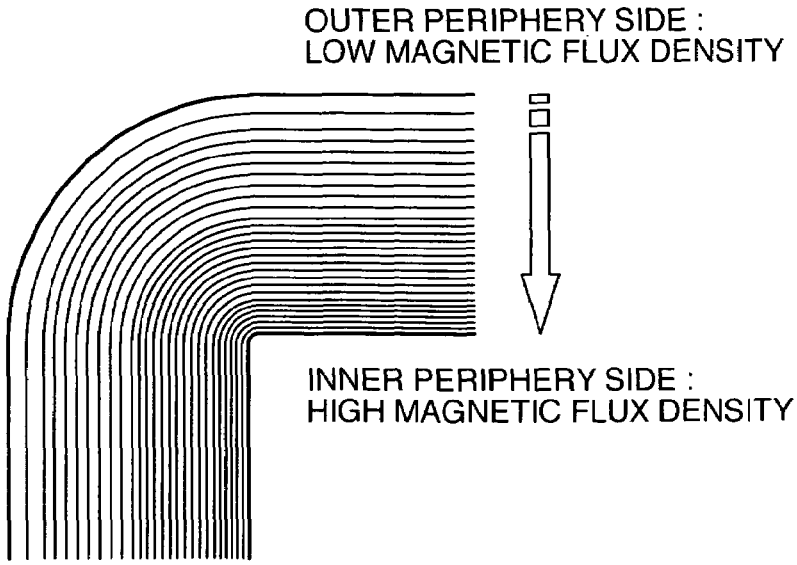

Conventionally, a wound iron core for a transformer is manufactured with magnetic steel sheets of an identical type having an identical magnetic characteristic laminated inside the same iron core as shown in FIG. 2. And magnetic flux in a magnetic flux distribution inside this wound iron core 4 is mal-distributed toward the inner periphery side having a shorter magnetic path and smaller magnetic resistance of magnetic steel sheets laminated as shown in FIG. 3. Therefore, the inner periphery side of the wound iron core on which magnetic flux is concentrated has a high magnetic flux density and its iron loss increases.

Therefore, the present invention adopts a wound iron core having such a structure that a magnetic steel sheet having an inferior magnetic characteristic is disposed on the inner periphery side having a shorter magnetic path and a magnetic steel sheet having a magnetic characteristic superior to that on the inner periphery side is disposed on the outer periphery side having a longer magnetic path to thereby make uniform the magnetic flux distribution in a sectional area of the iron core.

Embodiment 1

Figure 1:
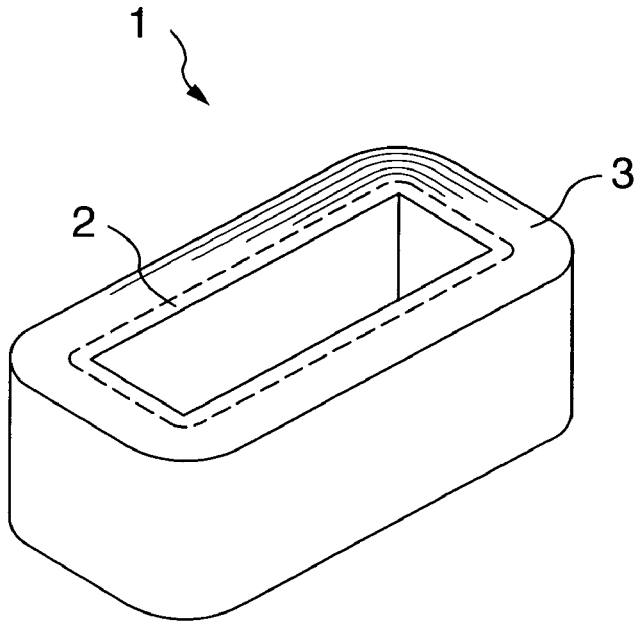
FIG. 1 is a perspective view showing the structure of a wound iron core according to the present invention.
Figure 4:
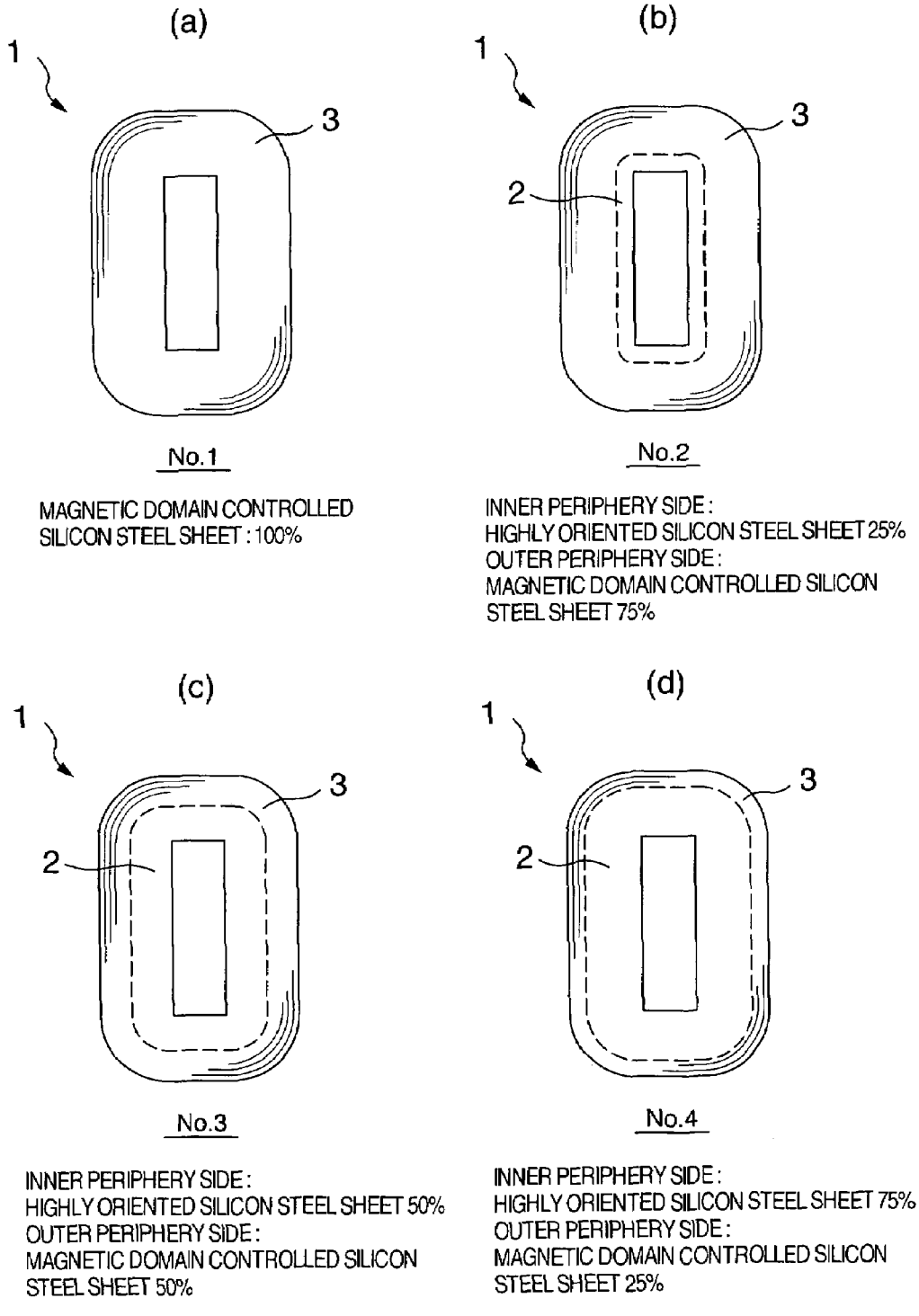
FIG. 4 is a front view of an iron core for characteristic verification according to the present invention.

FIG. 1 shows a wound iron core 1 manufactured using two types of magnetic steel sheets having different magnetic characteristics, which is a wound iron core made up of a highly oriented silicon steel sheet 2 disposed on the inner periphery side of the wound iron core 1 and a magnetic domain controlled silicon steel sheet 3 having a magnetic characteristic superior to that of the highly oriented silicon steel sheet 2 on the outer periphery side. Here, the "highly oriented silicon steel sheet" means a silicon steel sheet in which the rolling direction of the material matches the direction in which magnetic flux passes. The "magnetic domain controlled silicon steel sheet" means a silicon steel sheet made of a highly oriented silicon steel sheet as a raw material, on the surface of which shallow grooves are formed to fragment its magnetic domain and the magnetic characteristic of which is superior to that of the highly oriented silicon steel sheet. With regard to this wound iron core structure, various structures with different lamination thickness ratios between the magnetic steel sheets 2 and 3 are shown in No. 1 to No. 4 of FIG. 4. The wound iron core No. 1 in FIG. 4 is manufactured from only the magnetic domain controlled silicon steel sheet 3 for a characteristic comparison of iron loss. In contrast to this, the wound iron core No. 2 is made up of the highly oriented silicon steel sheet 2 disposed on the inner periphery side at a lamination thickness ratio of 25% and a magnetic domain controlled silicon steel sheet 3 having a magnetic characteristic superior to that of the highly oriented silicon steel sheet 2 disposed on the outer periphery side at a lamination thickness ratio of 75%. The wound iron cores No. 3 and No. 4 are made up of the highly oriented silicon steel sheet 2 disposed on the inner periphery side at lamination thickness ratios of 50% and 75% respectively in the same way as for No. 2. Hereinafter, verification results of the iron loss characteristics of these wound iron cores will be explained.

Figure 5:
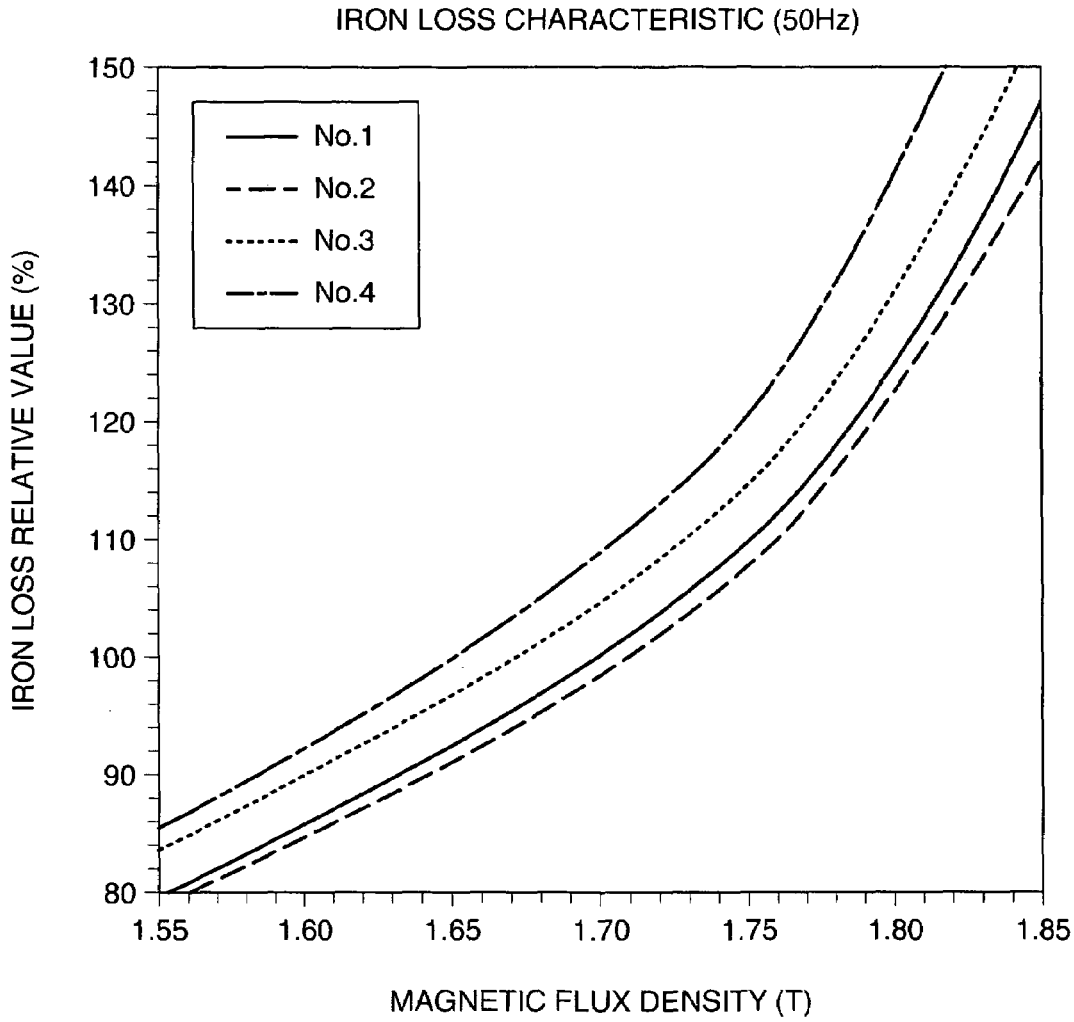
FIG. 5 illustrates an iron loss characteristic verification result according to the present invention.

FIG. 5 shows the results of excitation characteristic tests of iron loss with the respective iron cores No. 1 to No. 4 in FIG. 4, where the horizontal axis shows a magnetic flux density and the vertical axis shows a relative value of iron loss. In FIG. 5, it can be appreciated that when the magnetic flux density is changed from 1.55 T to 1.85 T, the characteristic of iron loss deteriorates in order of No. 2, No. 1, No. 3 and No. 4.

Figure 6:
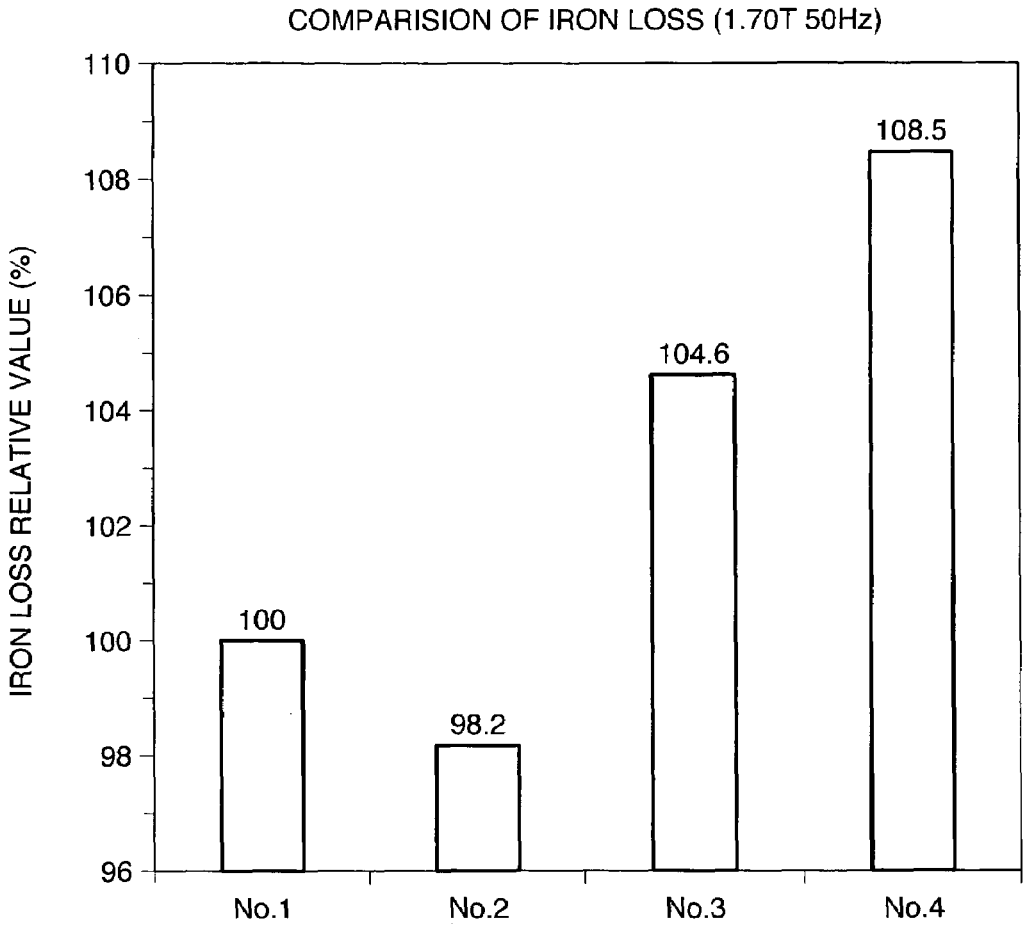
FIG. 6 is an iron loss characteristic comparative diagram at 1.70 T according to the present invention.

Furthermore, FIG. 6 shows a comparison between the respective iron loss values at a magnetic flux density of 1.70 T and shows the respective relative values (measured at a frequency of 50 Hz) of iron loss assuming that the iron loss value of No. 1 is 100%. In FIG. 6, the wound iron core No. 2 shows the best iron loss value and shows an improvement of approximately 2% over the iron loss value of the wound iron core made of only the magnetic domain controlled silicon steel sheet 3 of No. 1 at the magnetic flux density of 1.70 T. Furthermore, when the lamination thickness ratio of the highly oriented silicon steel sheet 2 on the inner periphery side becomes 50% or more, iron loss shows a strong tendency to increase.

It is generally known that magnetic flux in a wound iron core is mal-distributed toward an inner periphery side having a shorter magnetic path with respect to the total lamination thickness and smaller magnetic resistance. In this verification, the highly oriented silicon steel sheet 2 is disposed on the inner periphery side of the wound iron core and the magnetic domain controlled silicon steel sheet 3 having a magnetic characteristic superior to that of the highly oriented silicon steel sheet 2, that is, higher magnetic permeability is disposed on the outer periphery side, and the magnetic flux distribution in the sectional area of the iron core is thereby made uniform and iron loss improved. However, from this test result, it can be confirmed that even when the highly oriented silicon steel sheet 2 having a magnetic characteristic inferior to that on the outer periphery side is disposed on the inner periphery side, the wound iron core having the lamination thickness ratio of 50% of more has a greater amount of highly oriented silicon steel sheet 2 used and iron loss shows a tendency toward an increase. From above, the lamination thickness ratio of the highly oriented silicon steel sheet 3 having a magnetic characteristic inferior to that on the outer periphery side disposed on the inner periphery side is preferably 40% or less.

Iron loss of the iron core is calculated from the product of the iron loss (W/Kg) characteristic specific to each magnetic steel sheet and the mass used (Kg). Even when magnetic steel sheets of different magnetic characteristics are laminated inside the same iron core, iron loss is believed to be theoretically calculated from the sum of the product of the iron loss (W/Kg) characteristic specific to each magnetic steel sheet and the mass used (Kg). However, it has been verified that by disposing a magnetic steel sheet having a magnetic characteristic inferior to that on the outer periphery side on the inner periphery side of the wound iron core at an appropriate lamination thickness ratio, it is possible to make uniform the magnetic flux distribution in the sectional area of the iron core and obtain a smaller iron loss value than the aforementioned theoretical value of iron loss. Thus, it is possible to manufacture a low cost wound iron core with a reduced rate of increase of iron loss even when a magnetic steel sheet which is low cost and having an inferior magnetic characteristic is used on the inner periphery side of the wound iron core.

Embodiment 2

Figure 7:
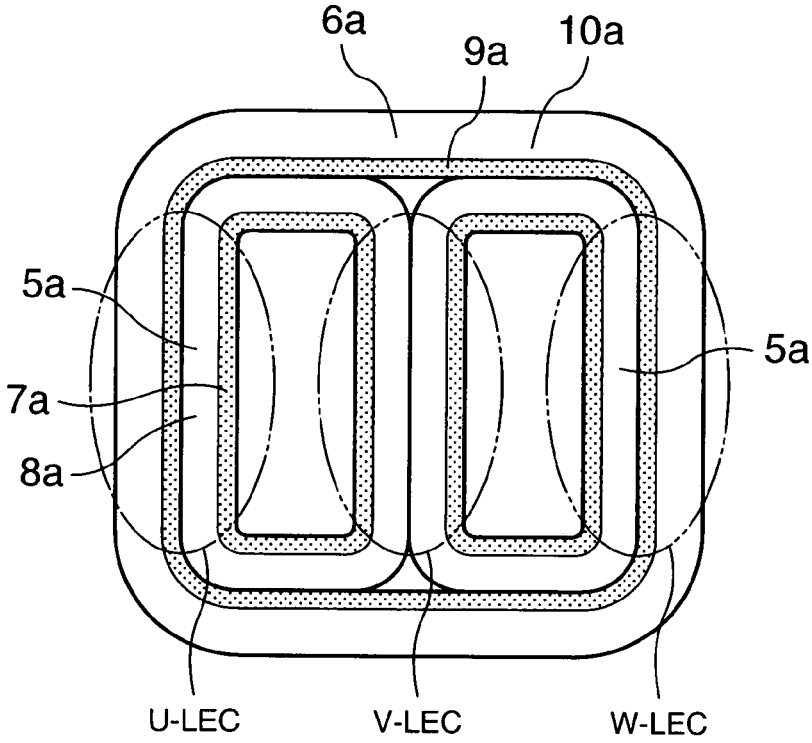
FIG. 7 is a front view showing an embodiment of a three-phase three-leg wound iron core according to the present invention.

FIG. 7 shows a three-phase three-leg wound iron core made up of two inner wound iron cores 5*a* and one outside wound iron core 6*a* disposed so as to surround the two inner wound iron cores, which is a wound iron core made up of directional silicon steel sheets 7*a*, 9*a* disposed on the inner periphery side of each wound iron core and highly oriented silicon steel sheets 8*a*, 10*a* having a magnetic characteristic superior to that of the directional silicon steel sheet disposed on the outer periphery side. In the three-phase three-leg wound iron core in FIG. 7, both the inside iron core 5*a* and outside iron core 6*a* are disposed such that both lamination thickness ratios of the directional silicon steel sheets 7*a*, 9*a* on the inner periphery side of each wound iron core are 25%. Furthermore, with regard to the lamination thickness ratio of the U-leg, V-leg and W-leg as a whole in the three-phase three-leg wound iron core in FIG. 7, the ratio of the directional silicon steel sheet is 25% for all legs.

Figure 8:
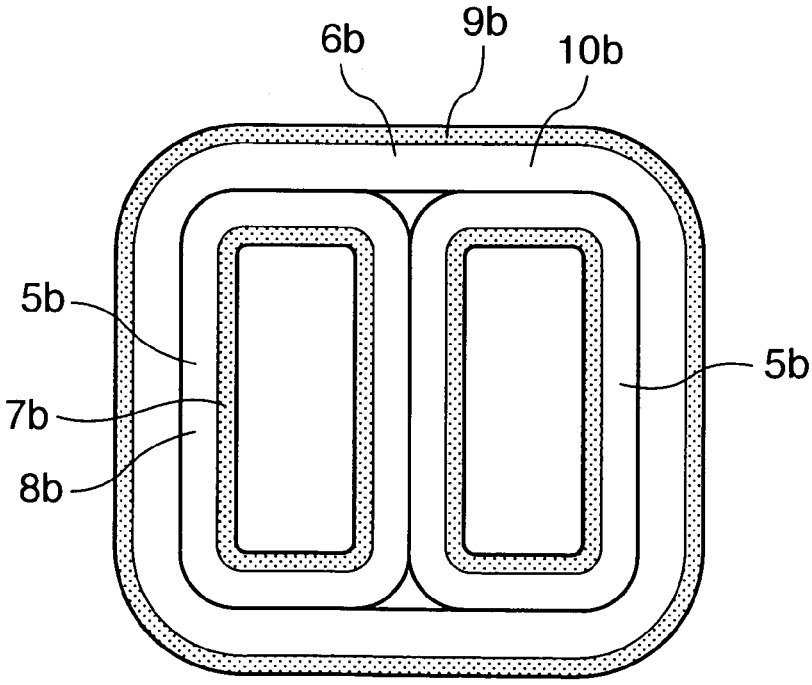
FIG. 8 is a front view showing another embodiment of the three-phase three-leg wound iron core according to the present invention.

The three-phase three-leg wound iron core in FIG. 8 is made up of two inside wound iron cores 5*b* and one outside wound iron core 6*b* disposed so as to surround the two inside wound iron cores and a directional silicon steel sheet 7*b* is disposed on the inner periphery side of the inside wound iron core 5*b*, a highly oriented silicon steel sheet 8*b* is disposed on the outer periphery side, a highly oriented silicon steel sheet 10*b* is disposed on the inner periphery side of the outside wound iron core 6*b* and a directional silicon steel sheet 9*b* is disposed on the outer periphery side. The three-phase three-leg wound iron core in FIG. 8 is arranged such that the lamination thickness ratio of the directional silicon steel sheet 7*b* disposed on the inner periphery side of the inside wound iron core 5*b* is 25% and the lamination thickness ratio of the directional silicon steel sheet 9*b* disposed on the outer periphery side of the outside wound iron core 6*b* is 25%. Furthermore, with regard to the lamination thickness ratio of the U-leg, V-leg and W-leg as a whole in the three-phase three-leg wound iron core in FIG. 8, the ratio of the directional silicon steel sheet is 25% for all legs.

Figure 9:
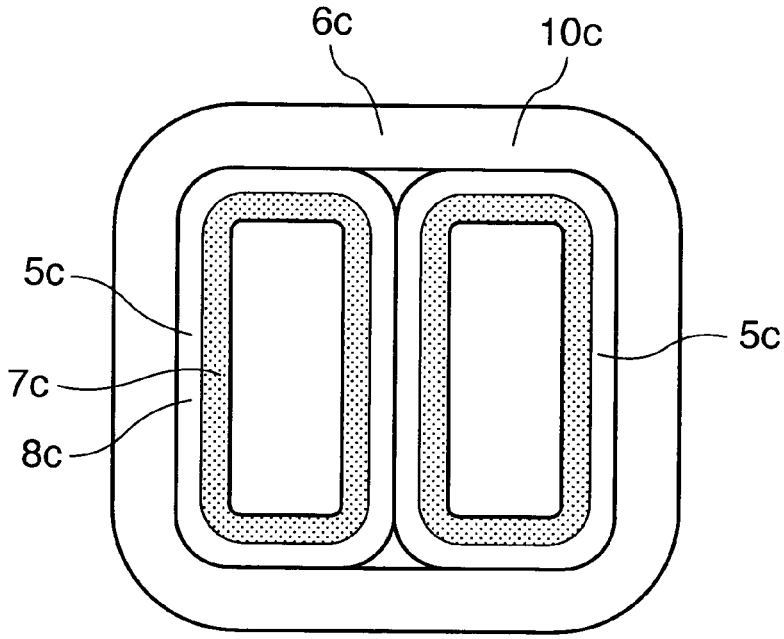
FIG. 9 is a front view showing a further embodiment of the three-phase three-leg wound iron core according to the present invention.

The three-phase three-leg wound iron core in FIG. 9 is made up of two inside wound iron cores 5*c* and one outside wound iron core 6*c* disposed so as to surround the two inside wound iron cores and a directional silicon steel sheet 7*c* is disposed on the inner periphery side of the inside wound iron core 5*c*, a highly oriented silicon steel sheet 8*c* is disposed on the outer periphery side, a highly oriented silicon steel sheet 10*c* is disposed for all the outside wound iron cores 6*c*. Note that the inside wound iron core 5*c* is disposed such that the lamination thickness ratio of the directional silicon steel sheet 7*c* disposed on the inner periphery side is 50%. Furthermore, the lamination thickness ratios of the U-leg, V-leg and W-leg as a whole in the three-phase three-leg wound iron core in FIG. 9 are U-leg 25%, V-leg 50% and W-leg 25% in the lamination thickness ratio of the directional silicon steel sheet.

Iron loss of the iron core is calculated from the product of the iron loss (W/Kg) characteristic specific to each magnetic steel sheet and the amount of mass used (Kg). Iron loss of the iron core is believed to be theoretically calculated from the sum of the product of the iron loss (W/Kg) characteristic specific to each magnetic steel sheet and the amount of mass used (Kg) even when magnetic steel sheets of different magnetic characteristics are laminated inside the same iron core.

However, according to the present invention, by disposing the magnetic steel sheet having a magnetic characteristic inferior to that on the outer periphery side on the inner periphery side of the wound iron core at an arbitrary ratio of lamination thickness, it is possible to obtain an iron loss value smaller than the theoretical value of iron loss calculated above and manufacture a low cost wound iron core with a suppressed increase rate of iron loss while using a low cost magnetic steel sheet having an inferior magnetic characteristic.

Embodiment 3

Figure 10:
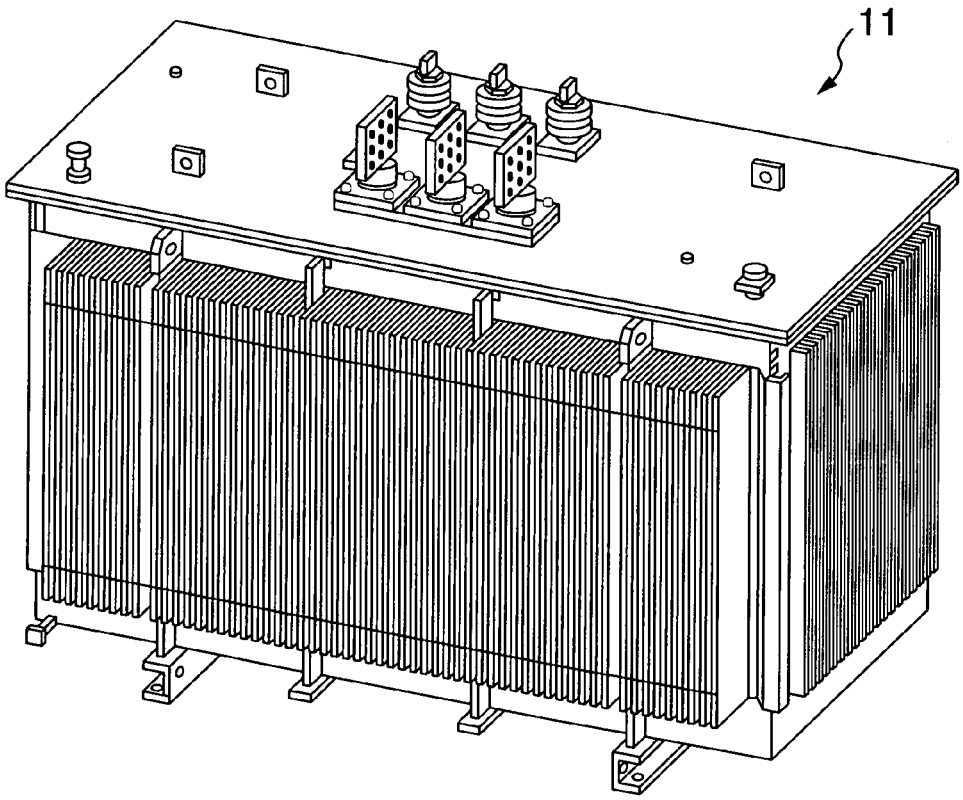
FIG. 10 illustrates a stationary apparatus (transformer) mounted with the wound iron core according to the present invention.

FIG. 10 shows a stationary apparatus 11 provided with the above described wound iron core, that is, a wound iron core made up of magnetic steel sheets having a magnetic characteristic inferior to that on the outer periphery side disposed on the inner periphery side having a shorter magnetic path and smaller magnetic resistance and magnetic steel sheets having a magnetic characteristic superior to that on the inner periphery side disposed on the outer periphery side having a longer magnetic path and greater magnetic resistance.

Furthermore, the stationary apparatus 11 provided with an iron core, which is the above described stationary apparatus provided with a wound iron core made up of magnetic steel sheets having a magnetic characteristic inferior to that on the outer periphery side disposed on the inner periphery side having a shorter magnetic path and smaller magnetic resistance so as to account for 40% or less of the total lamination thickness and magnetic steel sheets having a magnetic characteristic superior to that on the inner periphery side disposed on the outer periphery side is shown.

Furthermore, the stationary apparatus 11 provided with an iron core, which is the above described stationary apparatus, wherein a highly oriented silicon steel sheet is used as the magnetic steel sheet on the inner periphery side of the wound iron core and a magnetic domain controlled silicon steel sheet is used as the magnetic steel sheet on the outer periphery side is shown.

Furthermore, the stationary apparatus 11 provided with a three-phase three-leg wound iron core, which is a stationary apparatus provided with a three-phase three-leg wound iron core made up of 2 inner iron cores and 1 outer iron core, wherein each iron core is formed so that at least one leg of U-leg, V-leg and W-leg is a combination of magnetic steel sheets having different magnetic characteristics and each iron core is formed so that the magnetic material having an inferior magnetic characteristic accounts for 50% or less of the total lamination thickness of one leg is shown.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A wound iron core for a stationary apparatus made up of laminated magnetic steel sheets, comprising a first magnetic steel sheet disposed on an inner periphery side and a second magnetic steel sheet disposed on an outer periphery side, said inner periphery side having a shorter magnetic path and smaller magnetic resistance and said outer periphery side having a longer magnetic path and greater magnetic resistance, wherein:

said first magnetic steel sheet has a magnetic characteristic inferior to that of said second magnetic steel sheet;

said second magnetic steel sheet has a magnetic characteristic superior to that of said first magnetic steel sheet; and, said first magnetic steel sheet is disposed such that the thickness thereof accounts for 40% or less of the total lamination thickness of the wound iron core and said second magnetic steel sheet is disposed on the outer periphery side.

2. The wound iron core for a stationary apparatus according to claim 1, wherein a highly oriented silicon steel sheet is used for said first magnetic steel sheet and a magnetic domain controlled silicon steel sheet is used for said second magnetic steel sheet.

3. A stationary apparatus provided with a wound iron core made up of laminated magnetic steel sheets, the wound iron core comprising a first magnetic steel sheet disposed on an inner periphery side and a second magnetic steel sheet disposed on an outer periphery side, said inner periphery side having a shorter magnetic path and smaller magnetic resistance and said outer periphery side having a longer magnetic path and greater magnetic resistance, wherein:

said first magnetic steel sheet has a magnetic characteristic inferior to that of said second magnetic steel sheet;

said second magnetic steel sheet has a magnetic characteristic superior to that of said first magnetic steel sheet; and said first magnetic steel sheet is disposed such that the thickness thereof accounts for 40% or less of the total lamination thickness of the wound iron core and said second magnetic steel sheet is disposed on the outer periphery side.

4. The stationary apparatus according to claim 3, wherein a highly oriented silicon steel sheet is used for said first magnetic steel sheet and a magnetic domain controlled silicon steel sheet is used for said second magnetic steel sheet.

5. A wound iron core for a stationary apparatus made up of laminated magnetic steel sheets, comprising a first magnetic steel sheet disposed on an inner periphery side and a second magnetic steel sheet disposed on an outer periphery side, the inner periphery side having a shorter magnetic path and smaller magnetic resistance and the outer periphery side having a longer magnetic path and greater magnetic resistance, the first magnetic steel sheet and the second magnetic steel sheet having different magnetic characteristics, wherein the wound iron core has an iron loss value less than that of an iron core of substantially the same dimensions but made of only the second magnetic steel, and wherein the first magnetic steel sheet is disposed such that the thickness thereof accounts for 40% or less of the total lamination thickness of the wound iron core and the second magnetic steel sheet is disposed on the outer periphery side.

6. The wound iron core for a stationary apparatus according to claim 5, wherein the first magnetic steel sheet has a magnetic characteristic inferior to that of the second magnetic steel sheet, and the second magnetic steel sheet has a magnetic characteristic superior to that of the first magnetic steel sheet.

7. The wound iron core for a stationary apparatus according to claim 5, wherein a highly oriented silicon steel sheet is used for the first magnetic steel sheet and a magnetic domain controlled silicon steel sheet is used for the second magnetic steel sheet.

8. A stationary apparatus comprising the wound iron core according to claim 5.

* * * * *